US007458814B2

(12) United States Patent
Hur

(10) Patent No.: US 7,458,814 B2
(45) Date of Patent: Dec. 2, 2008

(54) TWIST-CHECK SOCKET AND ELECTRONIC ARTICLES EQUIPPED WITH THE SAME

(75) Inventor: Suhp Hur, Gwangmyeong-si (KR)

(73) Assignee: SGI Co., Ltd., Gwangmyeong-si (KR)

( * ) Notice: Subject to any disclaimer, the term of this patent is extended or adjusted under 35 U.S.C. 154(b) by 84 days.

(21) Appl. No.: 11/688,003

(22) Filed: Mar. 19, 2007

(65) Prior Publication Data

US 2007/0218746 A1 Sep. 20, 2007

(30) Foreign Application Priority Data

Mar. 20, 2006 (KR) ..... 10-2006-0025176

(51) Int. Cl.
*H01R 39/00* (2006.01)

(52) U.S. Cl. ..... 439/21

(58) Field of Classification Search ..... 439/20, 439/21, 22, 29, 640, 23, 24
See application file for complete search history.

(56) References Cited

U.S. PATENT DOCUMENTS 1,712,666 A * 5/1929 Guest ..... 439/21
6,000,948 A * 12/1999 Peterson ..... 439/22
2007/0054508 A1* 3/2007 Cheng ..... 439/13

* cited by examiner

*Primary Examiner*—Phuong K Dinh
(74) *Attorney, Agent, or Firm*—Stein, McEwen & Bui, LLP

(57) ABSTRACT

The present invention provides a twist prevention socket and an electrical device having the socket. The socket of the present invention includes a housing and a first plug, which is provided in an insertion part of the housing. The socket further includes a mediating structure, which includes a first connection member, which is connected to the first contact member of the second plug, and a second connection member, which is connected to the second contact member of the second plug and is electrically isolated from the first connection member. The socket further include a locking structure, which includes an elastic compressing member that is provided adjacent to the second plug and the mediating structure to ensure no-load operation of the second plug with respect to the mediating structure and provide a predetermined amount of resistance to removal of the second plug from the mediating structure.

9 Claims, 3 Drawing Sheets

TWIST-CHECK SOCKET AND ELECTRONIC ARTICLES EQUIPPED WITH THE SAME

CROSS-REFERENCE TO RELATED APPLICATION

This application claims the benefit of Korean Patent Application No. 2006-25176, filed Mar. 20, 2006, in the Korean Intellectual Property Office, the disclosures of which are incorporated herein by reference.

BACKGROUND OF THE INVENTION

1. Field of the Invention

The present invention relates generally to sockets for preventing power cords from becoming twisted using no-load rotation thereof and electrical devices having the sockets, and, more particularly, to a twist prevention socket, which includes a housing, having a second plug provided with two contact members that are connected to respective connection wires for supplying power and form a structure of concentric circles, and a mediating means, which is removably coupled to the second plug and has a connection member for ensuring no-load rotation of the second plug coupled to the mediating means, thus being more convenient for a user.

2. Description of the Related Art

Representative examples of conventional techniques pertaining to twist prevention structures for cables, such as power cords for electrical devices, were proposed in Korean Utility Model Publication No. 1990-0001560 (date: Feb. 28, 1990), which is entitled "PLUG AND JACK OF TELEPHONE FOR PREVENTING WIRE FROM TWISTING", Korean Utility Model Registration No. 0165033 (Oct. 13, 1999), which is entitled "APPARATUS FOR PREVENTING CORD OF TELEPHONE FROM TWISTING", Korean Utility Model Registration No. 0167150 (Oct. 30, 1999), Korean Patent Laid-open Publication No. 1999-0021304 (Mar. 25, 1999), which is entitled "STRUCTURE FOR PREVENTING POWER CORD OF HAIR DRYER FROM TWISTING", and Korean Utility Model Laid-open Publication No. 1998-0066628 (Dec. 05, 1998), which is entitled "TWIST PREVENTION POWER CORD".

In almost all conventional techniques, the twist prevention structure is realized by a sleeve structure, in which a cylindrical rotary body is inserted into and electrically connected to a sleeve.

However, almost all conventional twist prevention structures used in various types of cables, for example, power cords, telephone wires, etc., have an integrated structure, rather than a separable structure using a plug and a jack, and thus there is a disadvantage in that they are inconvenient to pack, store and carry.

SUMMARY OF THE INVENTION

Accordingly, the present invention has been made keeping in mind the above problems occurring in the prior art, and an object of the present invention is to provide a twist prevention socket, which includes a second plug provided with first and second contact members having a structure of concentric circles, a mediating means that has two connection members connected to the respective contact members, and a locking means for increasing ease of assembly of the second plug and the mediating means, and an electrical device provided with the socket such that, when it is desired to use an electrical device, a power cord can be easily connected to the electrical device, and, when it is desired to store or carry the electrical device, the power cord can be easily removed from the electrical device.

Another object of the present invention is to provide a removal twist prevention socket, in which an elastic compressing member for the locking means is provided on the mediating means, thus providing appropriate coupling force, and ensuring ease of assembly.

In order to accomplish the above objects, the present invention provides a twist prevention socket, including: a housing; a first plug provided in an insertion part of the housing, the first plug being connected to a jack of a power cord; a second plug provided in the housing at a position opposite the first plug and comprising a first contact member and a second contact member, which are connected to respective connection wires connected to the first plug, the first and second contact members being prevented from being electrically connected to each other and having an arrangement of concentric circles; a mediating means, comprising a first connection member, connected to the first contact member of the second plug, and a second connection member, connected to the second contact member of the second plug and electrically separated from the first connection member; and a locking means, having an elastic compressing member provided adjacent to the second plug and the mediating means to ensure no-load operation of the second plug with respect to the mediating means and provide a predetermined resistance to removal of the second plug from the mediating means.

Furthermore, to increase ease of assembly between the second plug and the mediating means, the elastic compressing member of the locking means may include an elastic piece provided on a main body of the mediating means.

Preferably, the elastic piece may comprise a plurality of elastic pieces, and a cutting space may be defined between the adjacent elastic pieces.

In addition, the twist prevention socket may further includes: a compressing protrusion provided on an inner surface of the elastic piece; and a removal prevention groove formed in the second plug, so that, when the second plug is coupled to the mediating means, the compressing protrusion of the elastic piece is locked to the removal prevention groove.

As well, the twist prevention socket may further include a direction indication means provided in the main body of the mediating means to indicate an installation position of the socket.

Additional aspects and/or advantages of the invention will be set forth in part in the description which follows and, in part, will be obvious from the description, or may be learned by practice of the invention.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION OF THE EMBODIMENTS

Figure 1:
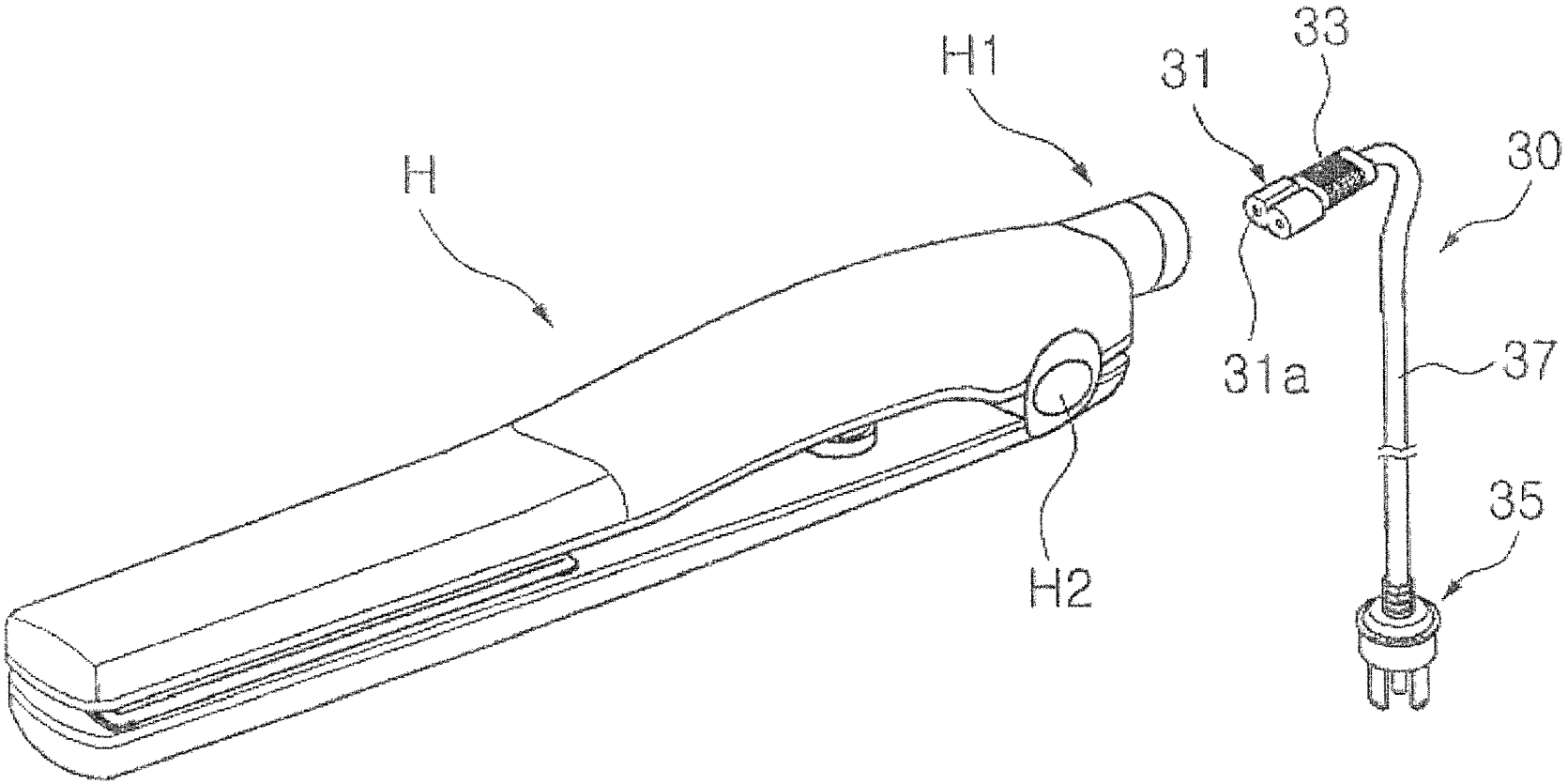
FIG. 1 is a perspective view of an electrical device having a twist prevention socket and a power cord, according to an embodiment of the present invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

The same reference numerals throughout the drawings, that is, the same reference numerals in a second digit and a first digit, or in a second digit, a first digit and an alphabet character, denote elements having the same function. If not specifically mentioned otherwise, the elements denoted by the reference numerals are to be comprehended as complying with the above-mentioned reference scheme.

In the description of a twist prevention socket according to an embodiment of the present invention, the direction in the attached FIGS. 1 through 3 will be defined as follows, for the convenience of description.

In the structure such that a jack 31 provided on a first end of a power cord 30 is connected to a first plug 11 provided in a housing 10 of the socket S and the socket S is freely rotatable with respective to an electrical device, the side adjacent to the first plug 11 to be connected to the jack of the power cord 30 is defined as the rear side, and the side adjacent to a main body 21 of a mediating means 20, which is rotatable with respective to the housing 10 having the first plug 11, is defined as the front side.

Figure 2:
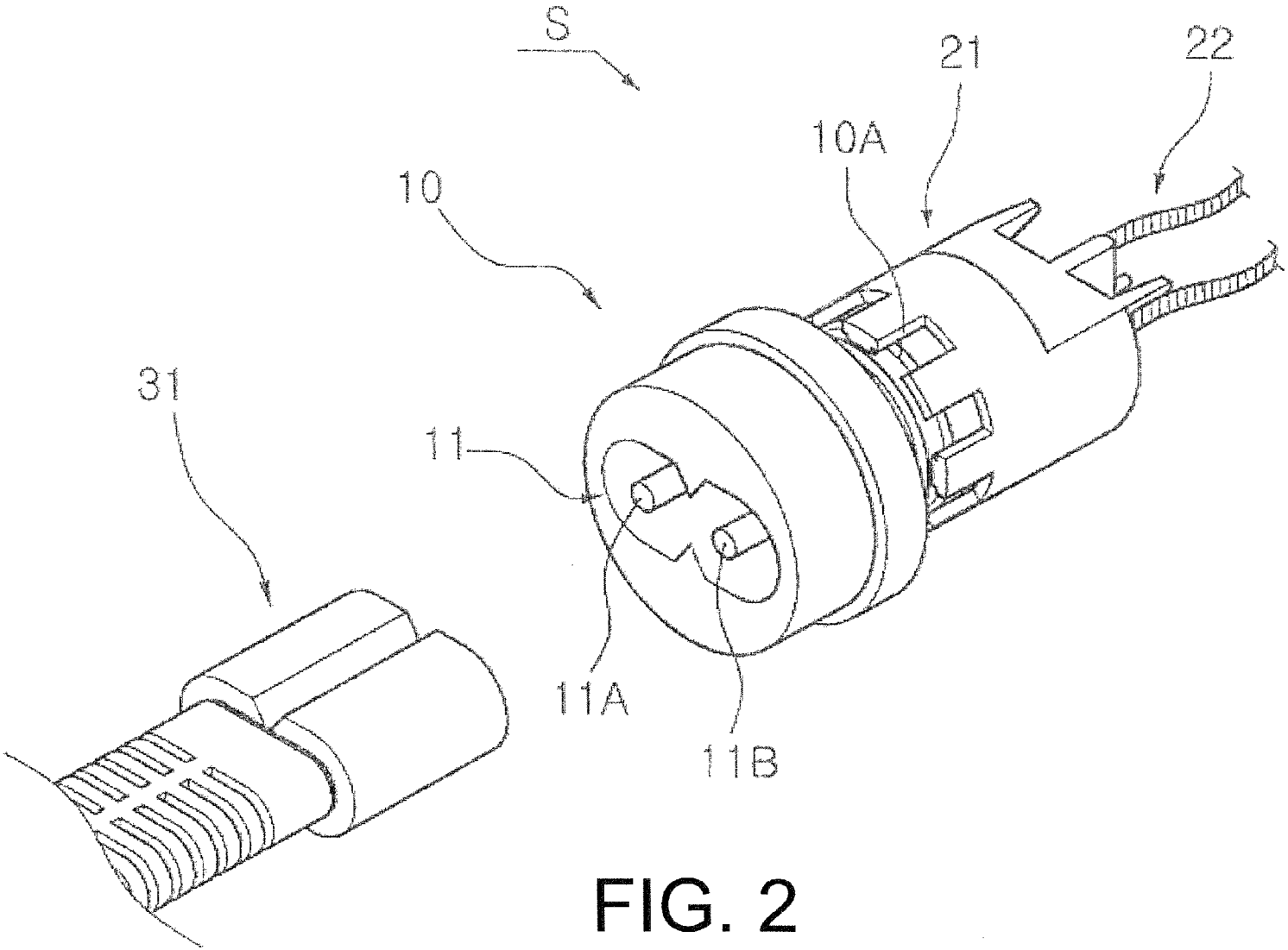
FIG. 2 is an enlarged perspective view showing the twist prevention socket and a jack of the power cord according to the present invention.

As shown in FIGS. 1 and 2, the power cord 30 has on the first end thereof the jack 31 to be connected to the first plug 11 of the socket S. A main plug 35, to be connected to a power outlet, which is provided in a living room, a bathroom, or some other room, is provided on a second end of the power cord 30, opposite the jack 31. In particular, the main plug 35 is a plug for three-phase power.

In the power cord 30, a copper core is coated with an insulation covering 37.

A damage-prevention corrugated part 33 is formed on the power cord 30 behind the jack 31.

Two insertion holes 31*a*, which are symmetrical with each other, are formed in the jack 31 of the power cord 30.

The socket S of the present invention is provided in a power connection part of the electrical device. Particularly, in the embodiment of the present invention, the socket S is illustrated as being provided in a power connection part H1 of a hair ion H, which is used to style the hair of a user using two heating rod parts that are coupled to each other so as to be rotatable around a hinge H2.

Figure 3:
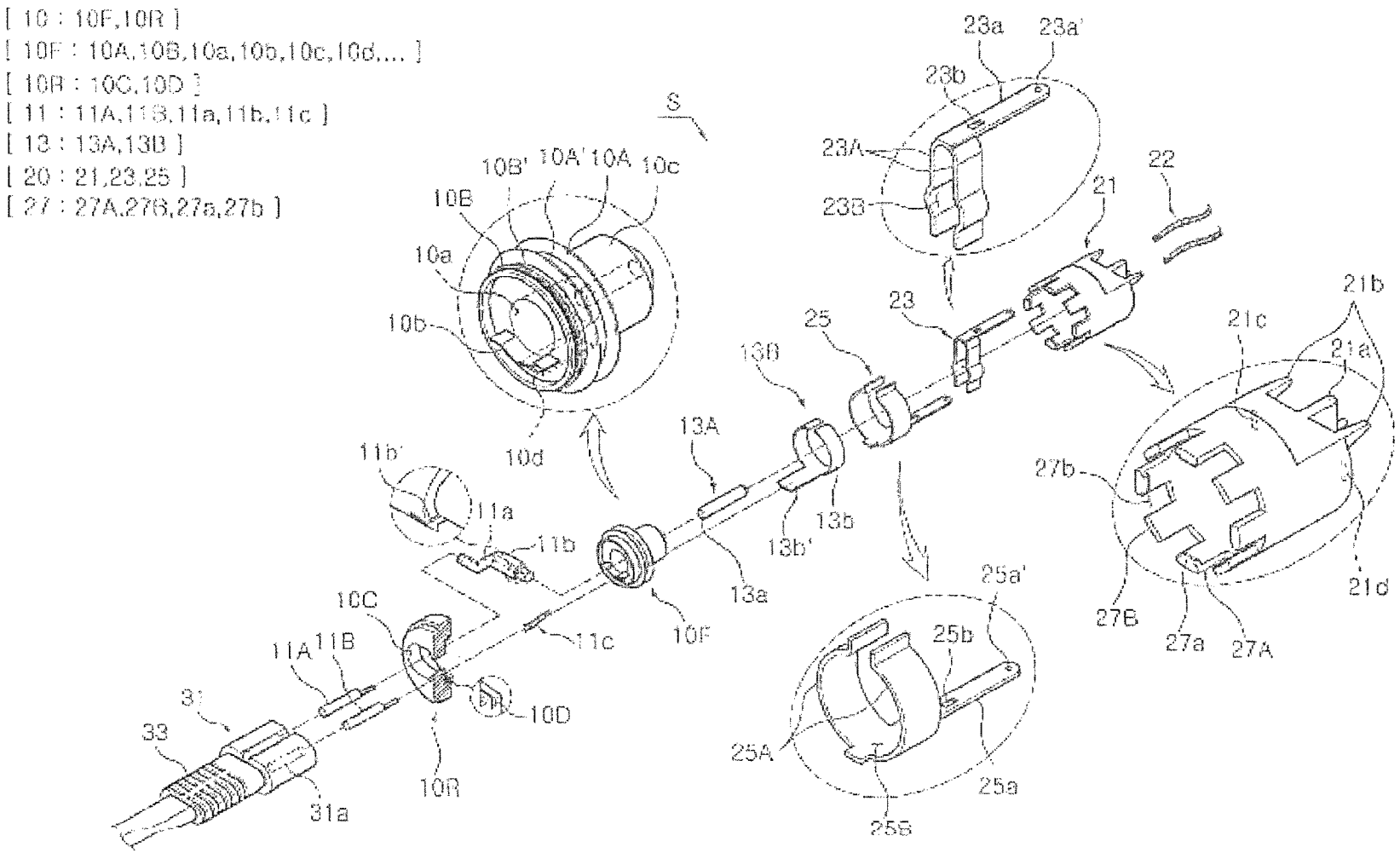
FIG. 3 is an exploded perspective view showing the twist prevention socket according to the present invention.

Referring to FIGS. 1 through 3, the first plug 11 and a second plug 13, which, along with the mediating means 20, are important elements of the socket S of the present invention, are installed in the housing 10.

The housing 10 is divided into a front body part 10F and a rear body part 10R to ensure ease of assembly thereof.

The rear body part 10R has therethrough an insertion part 10C, into which the jack 31 is inserted, and a hole (not designated by a reference numeral), into which two protrusions 11A and 11B constituting the first plug 11 are inserted.

Furthermore, an inward protruding front edge 10D, which engages with a locking groove 10B' defined by a locking ring 10B of the front body part 10F, is provided in the rear body part 10R.

The front body part 10F of the housing 10 has therethrough an insertion hole 10*a* for insertion of a first contact member 13A of the second plug 13.

Here, a front end of the insertion hole 10*a* has a shape and an inner diameter appropriate to contact and receive the first contact member 13A.

In addition, a rear end of the insertion hole 10*a* has a shape and an inner diameter appropriate to contact and receive a portion of a covering 11*b*, which covers one protrusion 11A of the first plug 11 and the first contact member 13A of the second plug 13, other than a direction indicating groove 11*b*'.

Meanwhile, a removal prevention protrusion 10A and a removal prevention groove 10A', which are coupled to elastic compressing members 27A and 27B that serve to provide appropriate resistance when the second plug 13 is removed from the mediating means 20, are provided on the circumferential outer surface of the front end of the housing 10.

Furthermore, the locking ring 10B and a locking groove 10B', to which the inward protruding front edge 10D of the rear body part 10R is locked for coupling the rear body part 10R to the housing 10, are provided on the circumferential outer surface of the rear end of the housing 10.

The first plug 11 comprises the two conductive protrusions 11A and 11B, and the second plug 13 has the two contact members 13A and 13B, which have a structure of concentric circles.

Of the two contact members 13A and 13B of the second plug 13, the first contact member 13A has a protrusion shape and is provided with an insertion hole 13*a*, such that a connection wire 11*a* can be inserted into and welded to the first contact member 13A. A rear end of the connection wire 11*a* is connected to the protrusion 11A of the first plug 11.

The connection wire 11*a* is coated with the covering 11*b* described above, and is thus insulated. The direction indicating groove 11*b*', which corresponds to a direction indicating protrusion 10*b* of the front body part 10F of the housing 10, is formed in the covering 11*b*, thus reliably maintaining the position of the first contact member 13A coupled to the housing 10.

Furthermore, the second contact member 13B of the second plug 13 includes a ring-shaped contact part 13*b* and a connection piece 13*b*', which is integrated with the ring-shaped contact part 13*b*.

The contact part 13*b* is fitted over the circumferential outer surface of a mounting part 10*c* of the front body part 10F of the housing 10.

The connection piece 13*b*' is inserted into an insertion slot 10*d* of the housing 10 and is connected to another connection wire 11*c* by welding. A rear end of the connection wire 11*c* is welded to the second protrusion 11B of the second plug 11.

Hereinafter, the mediating means 20, having a first connection member 23 and a second connection member 25, which are respectively related to the first and second contact members 13A and 13B of the second plug 13 having the above-mentioned construction, will be described in detail with reference to FIG. 3.

It is preferable for the mediating means 20 to be able to be installed in the electrical device in only a particular direction for convenience of assembly thereof.

To achieve the above-mentioned purpose, an installation direction limiting means is preferably provided in the mediating means 20.

As shown in the drawings, a direction limiting piece 21*a* and two direction limiting protrusions 21*b*, which are provided on the front end of the main body 21 of the mediating means 20, serve as the installation direction limiting means of the mediating means 20. Alternatively, the installation direction limiting means is realized by forming the main body 21 of the mediating means 20 to have an elliptical shape.

In the mediating means 20, the first connection member 23 to be connected to the first contact member 13A of the second plug 13 is disposed at a front position in a mounting part 21A of the main body 21.

Here, a connection piece 23*a* of the first connection member 23 extends forwards from the outer surface of the main body 21 of the mediating means 20 through a slit 21*c* formed in the main body 21.

A connection hole 23*a*' is formed through the front end of the connection piece 23*a*, so that a connection wire 22 for supplying power to the electrical device H is inserted into and welded to the connection hole 23*a* of the connection piece 23*a*.

Furthermore, a locking protrusion 23*b*, which is formed by pressing, is provided on the connection piece 23*a* at a position adjacent to the slit 21*c* of the main body 21 of the mediating means 20, thus preventing the first connection member 23 from being undesirably removed from the main body 21.

The first contact member 13A of the second plug 13 is substantially connected to a connection part 23A' provided between two bent pieces 23A of the first connection member 23.

Furthermore, the second connection member 25, which is disposed in the mounting part 21A behind the first connection member 23, includes a connection piece 25*a*, which has in the front end thereof a connection hole 25*a*, into which a connection wire 22 is inserted and welded. The connection piece 25*a* of the second connection member 25 is inserted into a slit 21*d* of the main body 21 of the mediating means 20.

In the same manner as the first connection member 23, a locking protrusion 25*b* is provided on the second connection member 25 to prevent the second connection member 25 from being undesirably removed from the main body 21 of the mediating means 20.

In addition, the coupling between the second connection member 25 and the second contact member 13B of the second plug 13 is substantially realized by a structure in which the second contact member 13B is inserted into a connection part 25A' formed by two bent pieces 25A of the second connection member 25.

Hereinafter, a locking means 27, which is provided adjacent to the second plug 13 and the mediating means 20 to ensure no-load rotation of the second plug 13 with respect to the mediating means 20 and provide appropriate resistance to separation of the second plug 13 from the mediating means 20, will be described in detail.

As shown in FIG. 3, in the locking means 27, the elastic compressing members, which are the critical part of the locking means 27, comprise elastic pieces 27A and 27B, which are provided on the main body 21 of the mediating means 20.

The elastic pieces 27A and 27B are alternately spaced apart from each other at regular intervals by cutting spaces 27*b* defined therebetween.

In particular, compressing protrusions 27*a* are provided on respective inner surfaces of some elastic pieces, in detail, on respective inner surfaces of the elastic pieces 27A, which are alternated with the elastic pieces 27B, to provide appropriate resistance when the second plug 13 is separated from the mediating means 20.

When the second plug 13 is coupled to the mediating means 20, the compressing protrusions 27*a* of the elastic pieces 27A are locked to the removal prevention groove 10A', which is formed in the housing 10 of the second plug 13.

Thanks to the elastic compressing members having the above-mentioned construction, when the second plug and the mediating means are coupled to or removed from each other, the present invention does not require much attention or force. Furthermore, when the user uses the electrical device, such as a hair dryer or a hair iron, even if the electrical device is abruptly moved, the second plug is prevented from being undesirably removed from the mediating means, thus preventing safety hazards such as electric shocks.

As described above, the present invention provides a twist prevention socket, which includes a second plug provided with first and second contact members having the structure of concentric circles, a mediating means that has two connection members connected to the respective contact members, a locking means for increasing the ease of assembly between the second plug and the mediating means, and an electrical device having the twist prevention socket. Thus, when manufacturing products, ease of assembly thereof is ensured. Furthermore, the present invention is constructed such that, when it is desired to use the electrical device, a power cord can be easily connected to the electrical device, and, when it is desired to store or carry the electrical device, the power cord can be easily removed from the electrical device. Moreover, because an elastic compressing member for the locking means is provided on the mediating means, the ease of assembly is further enhanced.

Although a socket having a particular shape and structure according to the preferred embodiment of the present invention has been disclosed for illustrative purposes with reference to the attached drawings, those skilled in the art will appreciate that various modifications, additions and substitutions are possible, without departing from the scope and spirit of the invention. Therefore, these modifications, additions and substitutions must be regarded as falling within the bounds of the accompanying claims of the present invention.

What is claimed is:

1. A twist prevention socket, comprising:

a housing;

a first plug provided in an insertion part of the housing, the first plug being connected to a jack of a power cord;

a second plug provided in the housing at a position opposite the first plug and comprising a first contact member and a second contact member, which are connected to respective connection wires connected to the first plug, the first and second contact members being prevented from being electrically connected to each other and having an arrangement of concentric circles;

mediating means, comprising a first connection member, connected to the first contact member of the second plug, and a second connection member, connected to the second contact member of the second plug and electrically separated from the first connection member; and locking means, comprising an elastic compressing member provided adjacent to the second plug and the mediating means to ensure no-load operation of the second plug with respect to the mediating means and provide a predetermined resistance to removal of the second plug from the mediating means.

2. The twist prevention socket as claimed in claim 1, wherein the elastic compressing member of the locking means comprises an elastic piece provided on a main body of the mediating means.

3. The twist prevention socket as claimed in claim 2, wherein the elastic piece comprises a plurality of elastic pieces, and a cutting space is defined between the adjacent elastic pieces.

4. The twist prevention socket as claimed in claim 2, further comprising:

a compressing protrusion provided on an inner surface of the elastic piece; and a removal prevention groove formed in the second plug, so that, when the second plug is coupled to the mediating means, the compressing protrusion of the elastic piece is locked to the removal prevention groove.

5. The twist prevention socket as claimed in claim 1, further comprising:

direction indication means provided in the main body of the mediating means to indicate an installation position of the socket.

6. The twist prevention socket as claimed in claim 3, further comprising:

a compressing protrusion provided on an inner surface of the elastic piece; and a removal prevention groove formed in the second plug, so that, when the second plug is coupled to the mediating means, the compressing protrusion of the elastic piece is locked to the removal prevention groove.

7. The twist prevention socket as claimed in claim 2, further comprising:

direction indication means provided in the main body of the mediating means to indicate an installation position of the socket.

8. The twist prevention socket as claimed in claim 3, further comprising:

direction indication means provided in the main body of the mediating means to indicate an installation position of the socket.

9. An electrical device, having a twist prevention socket in a power connection part thereof, the twist prevention socket comprising:

a housing;

a first plug provided in an insertion part of the housing, the first plug being connected to a jack of a power cord;

a second plug provided in the housing at a position opposite the first plug and comprising a first contact member and a second contact member, which are connected to respective connection wires connected to the first plug, the first and second contact members being prevented from being electrically connected to each other and having an arrangement of concentric circles;

mediating means, comprising a first connection member connected to the first contact member of the second plug, and a second connection member connected to the second contact member of the second plug and electrically isolated from the first connection member; and locking means, comprising an elastic compressing member provided adjacent to the second plug and the mediating means to ensure no-load operation of the second plug with respect to the mediating means and provide a predetermined resistance to removal of the second plug from the mediating means.

* * * * *